US008002585B2

(12) United States Patent
Zhou

(10) Patent No.: US 8,002,585 B2
(45) Date of Patent: Aug. 23, 2011

(54) DETACHABLE LAMP SOCKET

(75) Inventor: Nan-Qing Zhou, Fujian (CN)

(73) Assignee: Mainhouse (Xiamen) Electronics Co., Ltd., Fujian (CN)

( * ) Notice: Subject to any disclaimer, the term of this patent is extended or adjusted under 35 U.S.C. 154(b) by 47 days.

(21) Appl. No.: 12/689,632

(22) Filed: Jan. 19, 2010

(65) Prior Publication Data

US 2010/0184321 A1 Jul. 22, 2010

(30) Foreign Application Priority Data

Jan. 20, 2009 (CN) ..... 2009 2 0136527 U

(51) Int. Cl.
*H01R 31/02* (2006.01)

(52) U.S. Cl. ..... 439/642; 439/320; 439/374; 439/376

(58) Field of Classification Search ..... 439/236, 439/313, 320, 374, 375, 376, 642, 645, 646, 439/929

See application file for complete search history.

(56) References Cited

U.S. PATENT DOCUMENTS 1,578,999 A * 3/1926 Kaschub ..... 439/343
1,835,688 A * 12/1931 Atwood ..... 439/642
2,239,846 A * 4/1941 Gifford ..... 439/642
2,290,816 A * 7/1942 Schauer ..... 439/342
2,489,741 A * 11/1949 Bonham ..... 439/347
2,825,799 A * 3/1958 Julien ..... 362/549
2,968,784 A * 1/1961 Mason ..... 439/680
3,003,058 A * 10/1961 Babcock ..... 362/296.07
3,017,469 A * 1/1962 Giller ..... 200/52 R
3,245,024 A * 4/1966 Evans ..... 439/67
3,723,947 A * 3/1973 Lozeau ..... 439/374
4,564,257 A * 1/1986 Smerz ..... 439/642
4,578,628 A * 3/1986 Siwiak ..... 320/127
4,645,283 A * 2/1987 MacDonald et al. ..... 439/236
5,003,330 A * 3/1991 Kotani et al. ..... 396/176
5,009,384 A * 4/1991 Gerke et al. ..... 248/343
5,063,611 A * 11/1991 Kitabayashi ..... 455/348
5,251,329 A * 10/1993 Takagi et al. ..... 455/572
5,283,420 A * 2/1994 Montalto ..... 219/432
5,431,570 A * 7/1995 Gibbs et al. ..... 439/39
5,744,934 A * 4/1998 Wu ..... 320/111
5,820,254 A * 10/1998 Duenas ..... 362/473
6,049,271 A * 4/2000 Chu ..... 340/463
7,905,626 B2 * 3/2011 Shantha et al. ..... 362/228
7,927,154 B2 * 4/2011 Sekela et al. ..... 439/699.2
2010/0167576 A1 * 7/2010 Zhou ..... 439/375

* cited by examiner

*Primary Examiner* — Neil Abrams

(57) ABSTRACT

A detachable lamp socket includes a contact member (1), a housing (2), and a fixing ring (3). A lower end of the contact member (1) is connected to an upper end of the housing (2). The fixing ring (3) is fitted on the junction of the contact member (1) and the housing (2) to fix the contact member (1) and the housing (2). The top of the housing (2) is provided with the engaging groove (22) and the bottom of the contact member (1) is provided with hooks (12). With the hooks (12) and the engaging groove (22), the contact member (1) and the housing (2) are connected together. The notch (221) of the engaging groove (22) is open, such that the hooks (12) of the contact member (1) are levelly pushed in the engaging groove (22). The fixing ring (3) may be threaded onto outer threads (23) of the housing (2) to complete the assembly. This can prevent a lamp base from being loosened when rotating a lamp, so that the contact member (1) and the housing (2) are connected firmly. Furthermore, this connection way is very easy, quick and convenient for disassembly and assembly.

3 Claims, 6 Drawing Sheets

DETACHABLE LAMP SOCKET

BACKGROUND OF THE INVENTION

1. Field of the Invention

The present invention relates to a lighting device, and more particularly to a detachable lamp socket.

2. Description of the Prior Art

A conventional energy-saving lamp for a lighting device comprises a lamp socket fixed on the lamp. Because the specification and shape of the lamp socket is different, the lighting device is limited when in use. For example, if the lamp base is in a snap-in type, a spiral-type lamp socket is not usable. Besides, the diameter of the lamp base must match with the diameter of the lamp socket. This is not convenient for use. Therefore, there are various detachable and assembled lamp sockets on the market. The applicant of the present invention has filed many applications for detachable and replaceable lamp sockets. The detachable and replaceable lamp socket comprises a contact member, a housing which is detachably connected to the contact member, and a fixing ring to fix the contact member and the housing. However, the connection of the contact member and the housing is not firm, and it is not convenient to disassemble and assemble the lamp.

SUMMARY OF THE INVENTION

The primary object of the present invention is to provide a detachable lamp socket, which is firm and convenient for disassembly and assembly and used widely.

In order to achieve the aforesaid object, the present invention comprising a contact member, a housing and a fixing ring. A lower end of the contact member is connected to an upper end of the housing. The fixing ring is fitted on the junction of the contact member and the housing to fix the contact member and the housing. A first conductive element disposed in the contact member is electrically connected to a second conductive element disposed in the housing. A top of the housing is provided with an engaging groove. The engaging groove has an open portion with a notch. At least two L-shaped hooks extending out from a bottom of the contact member. The two hooks are inserted through the notch to be engaged in the engaging groove when assembled.

Preferably, the bottom of the contact member is provided with three hooks. The engaging groove of the housing is annular. The annular engaging groove has the open portion with the notch. Two of the three hooks are transversely inserted through the notch to be engaged in the annular engaging groove and one of the three hooks is radially inserted in the annular engaging groove when assembled.

Preferably, the contact member has a collar disposed on a lower outer wall thereof, and the housing has outer threads formed on an upper outer wall thereon. The fixing ring is an annular member. The fixing ring has a reduced upper portion to form an inward flange and a lower portion formed with inner threads on an inner wall thereof. The fixing ring is fitted on the junction of the contact member and the housing. The flange at the upper portion of the fixing ring is engaged with the collar on the lower outer wall of the contact member. The inner threads formed on the inner wall of the lower portion of the fixing ring are engaged with the outer threads formed on the upper outer wall of the housing.

The feature of the present invention is that the top of the housing is provided with the engaging groove and the bottom of the contact member is provided with the hooks. With the hooks and the engaging groove, the contact member and the housing are connected together. The notch of the engaging groove is open, such that the hooks of the contact member are levelly pushed in the engaging groove. This can prevent a lamp base from being loosened when rotating a lamp, so that the contact member and the housing are connected firmly. Furthermore, this connection way is very convenient for disassembly and assembly. The contact member of the present invention can be replaced for snap-in lamp bases and spiral-type lamp bases, which is used widely.

DETAILED DESCRIPTION OF THE PREFERRED EMBODIMENTS

Embodiments of the present invention will now be described, by way of example only, with reference to the accompanying drawings.

Figure 1:
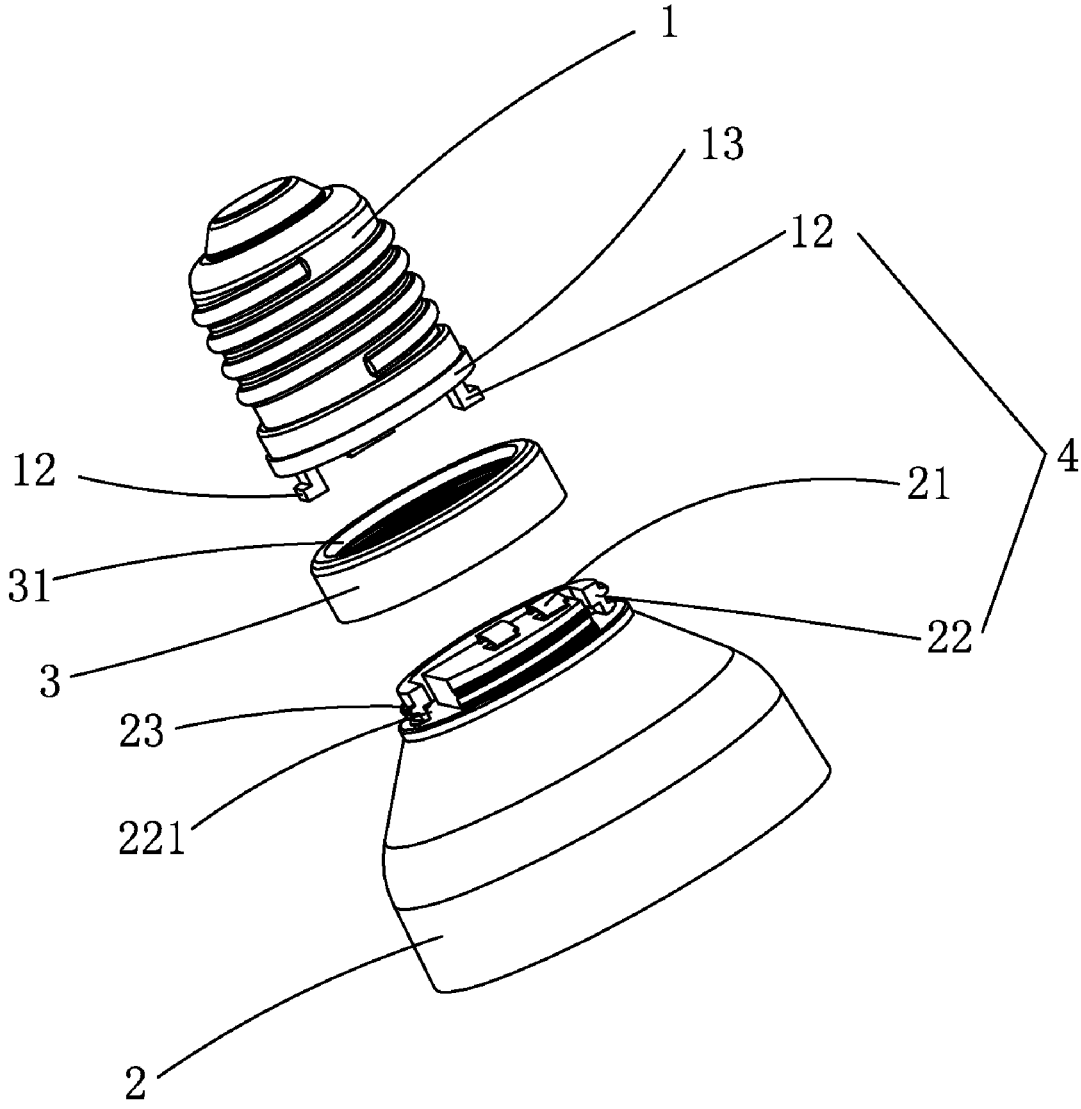
FIG. 1 is an exploded view of the present invention.

As shown in FIG. 1, the detachable lamp socket of the present invention comprises a contact member 1, a housing 2, and a fixing ring 3.

A lower end of the contact member 1 is connected to an upper end of the housing 2. The fixing ring 3 is fitted on the junction of the contact member 1 and the housing 2 so as to fix the contact member 1 and the housing 2. A first conductive element 11 disposed in the contact member 1 is electrically connected to a second conductive element 21 disposed in the housing 2, as shown in FIG. 6C. A resilient plate is used to connect the conductive elements.

A bottom of the contact member 1 and a top of the housing 2 are respectively provided with engaging portions 4 for engagement. The engaging portions 4 comprise an annular engaging groove 22 disposed on the top of the housing 2 and three hooks 12 extending out from the bottom of the contact member 1.

Figure 5A:
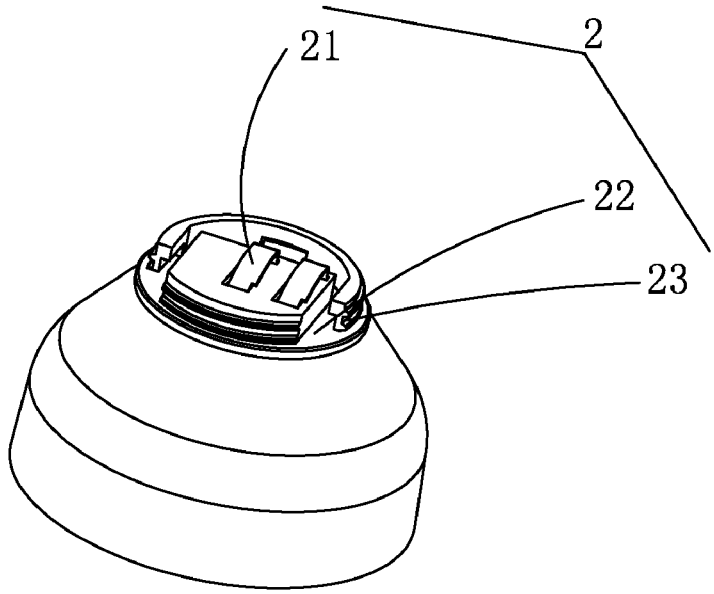
FIG. 5A is a perspective view of the housing of the present invention.
Figure 5B:
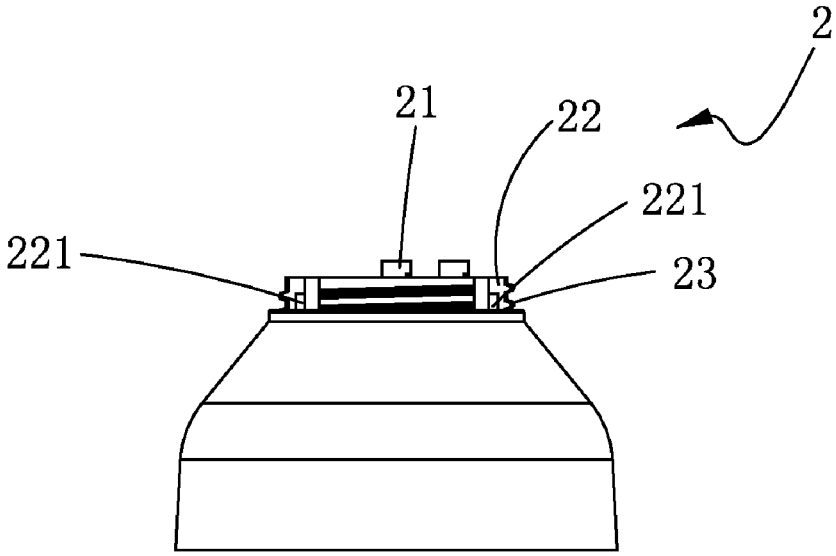
FIG. 5B is a front view of the housing of the present invention.
Figure 5C:
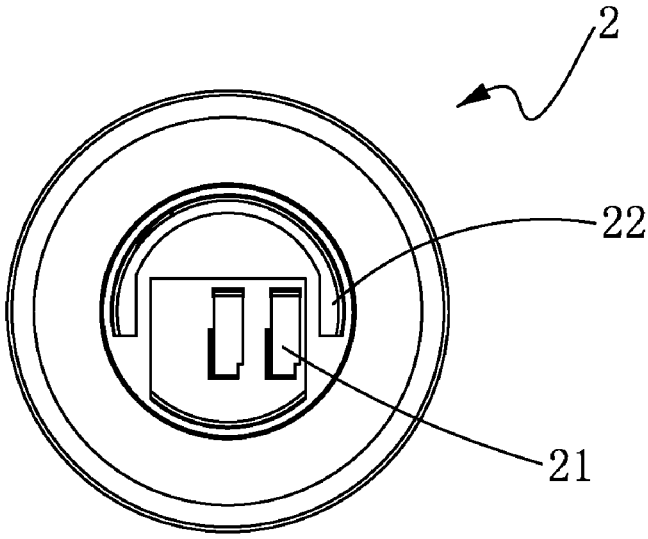
FIG. 5C is a bottom view of the housing of the present invention.
Figure 6A:
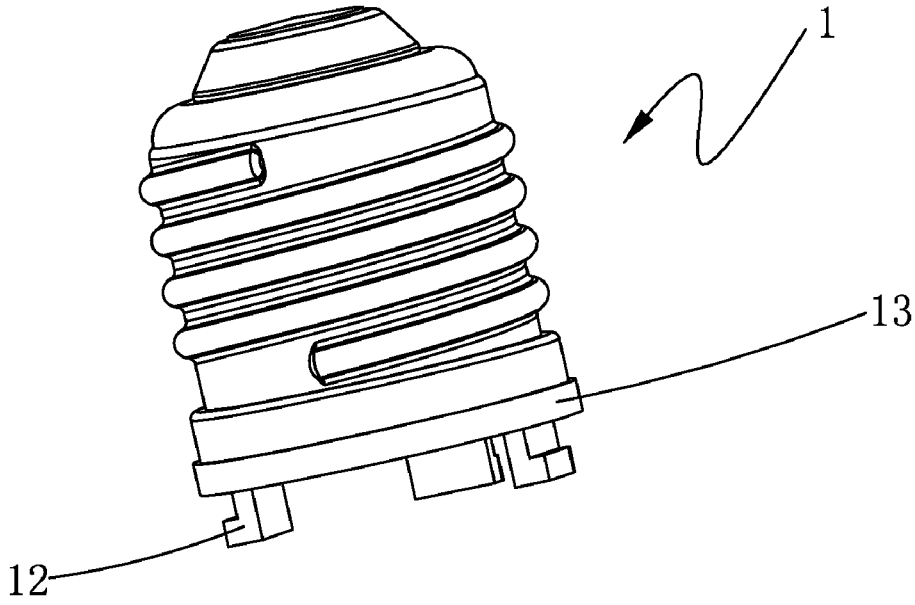
FIG. 6A is a perspective view of the contact member of the present invention.
Figure 6B:
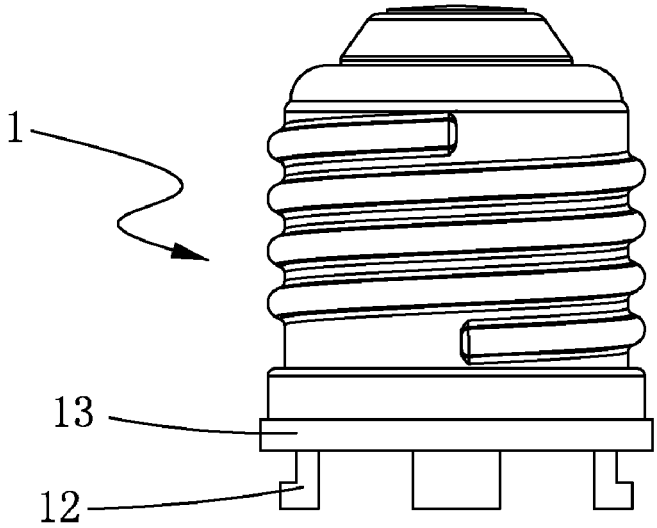
FIG. 6B is a front view of the contact member of the present invention.
Figure 6C:
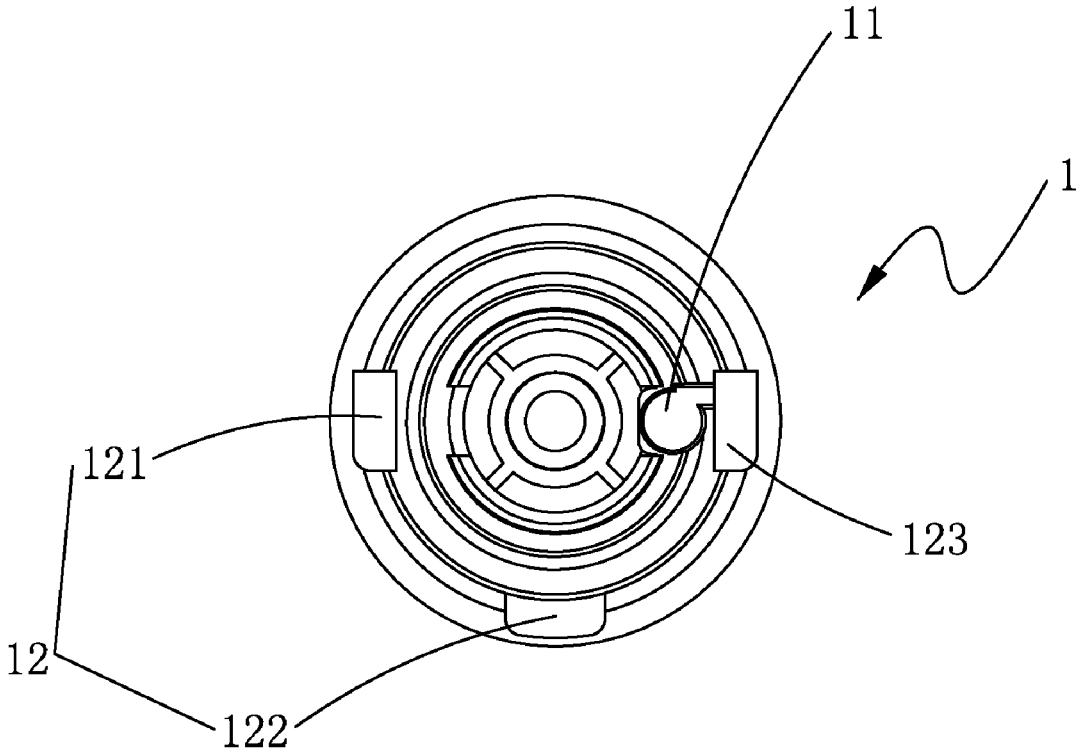
FIG. 6C is a bottom view of the contact member of the present invention.

As shown in FIG. 6A, FIG. 6B, FIG. 6C, each of the three hooks 121, 122, 123 of the contact member 1 is shaped like an English capital letter L. As shown in FIG. 5A, FIG. 5B, FIG. 5C, the annular engaging groove 22 on the top of the housing 2 has an open portion to form a semicircular engaging groove 22 with a notch 221. When assembled, two of the three hooks 12 are inserted through the notch 221 to be engaged in the annular engaging groove 22.

The contact member 1 has a collar 13 disposed on a lower outer wall thereof. The housing 2 has outer threads 23 formed on an upper outer wall thereon. The fixing ring 3 is an annular member, which has a reduced upper portion to form an inward flange 31 and a lower portion formed with inner threads on an inner wall thereof. The fixing ring 3 is fitted on the junction of the contact member 1 and the housing 2. The flange 31 at the upper portion of the fixing ring 3 is engaged with the collar 13 on the lower outer wall of the contact member 1. The inner threads formed on the inner wall of the lower portion of the fixing ring 3 are engaged with the outer threads 23 formed on the upper outer wall of the housing 2.

Figure 2:
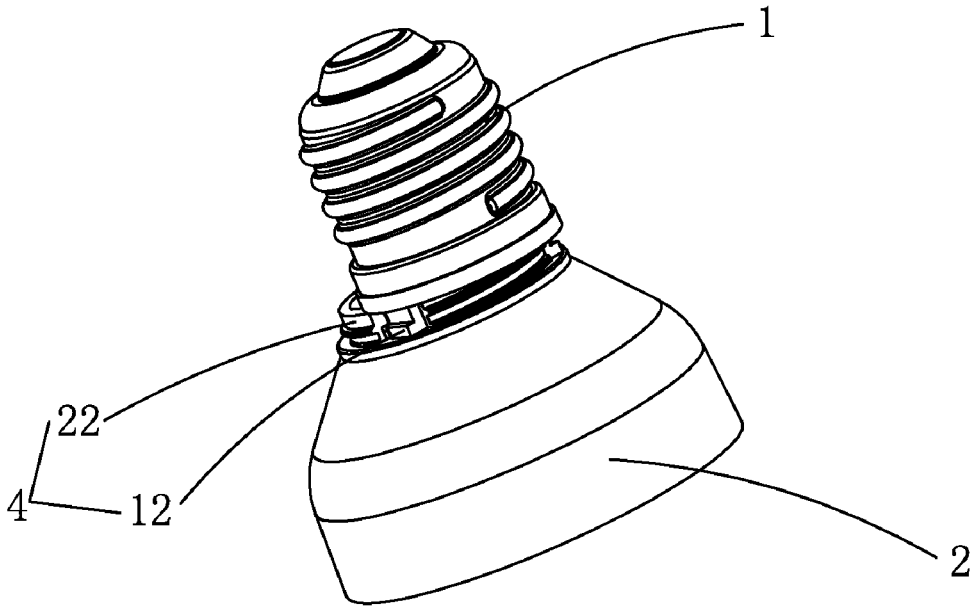
FIG. 2 is a perspective view of the present invention.
Figure 3:
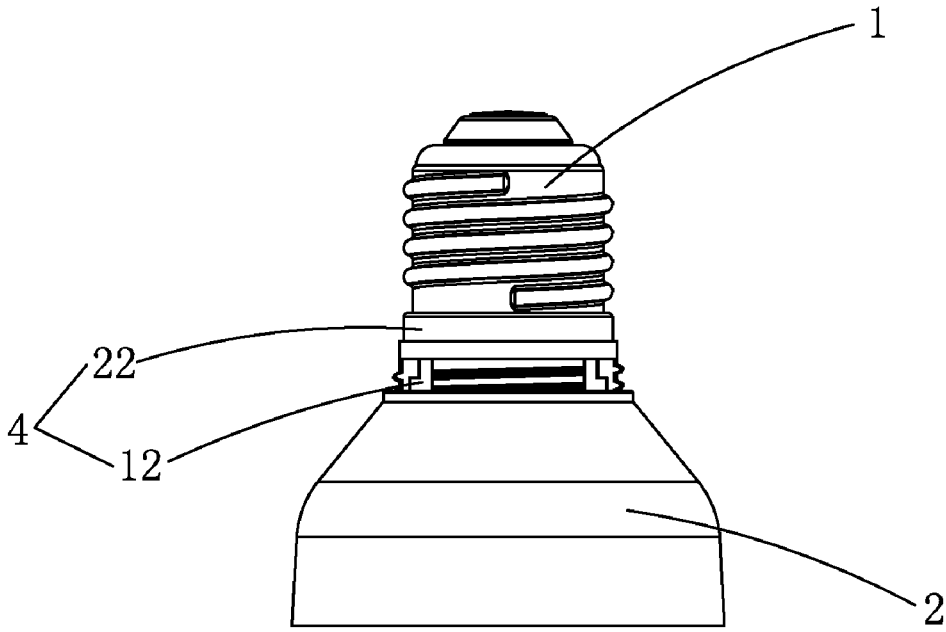
FIG. 3 is a front view showing the fixing ring of the present invention to be fitted.
Figure 4:
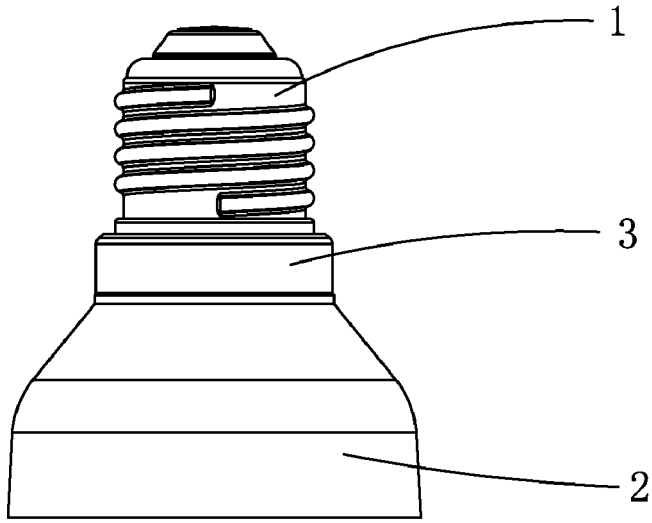
FIG. 4 is a front view of the present invention.

As shown in FIG. 2, FIG. 6C, FIG. 5A, to assemble the present invention, the two hooks 121, 123 of the contact member 1 are placed at the notch 221 of the annular engaging groove 22 while the hook 122 is placed inside the annular engaging groove 22, as shown in FIG. 3, and then the fixing ring 3 is rotated to complete the assembly of the present invention, as shown in FIG. 4.

The feature of the present invention is that the top of the housing is provided with the annular engaging groove and the bottom of the contact member is provided with the hooks. With the hooks and the annular engaging groove, the contact member and the housing are connected together.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A detachable lamp socket, comprising a contact member (1), a housing (2) and a fixing ring (3), a lower end of the contact member (1) being connected to an upper end of the housing (2), the fixing ring (3) being fitted on the junction of the contact member (1) and the housing (2) to fix the contact member (1) and the housing (2), a first conductive element (11) disposed in the contact member (1) being electrically connected to a second conductive element (21) disposed in the housing (2), a top of the housing (2) being provided with an engaging groove (22), the engaging groove (22) having an open portion with a notch (221), at least two L-shaped hooks (12) extending out from a bottom of the contact member (1), the two hooks (12) being inserted through the notch (221) to be engaged in the engaging groove (22) when assembled.

2. The detachable lamp socket as claimed in claim 1, wherein the bottom of the contact member (1) is provided with three hooks (12), the engaging groove (22) of the housing (2) being annular, the annular engaging groove (22) having the open portion with the notch (221), two of the three hooks (12) being transversely inserted through the notch (221) to be engaged in the annular engaging groove (22) and one of the three hooks (12) being radially inserted in the annular engaging groove (22) when assembled.

3. The detachable lamp socket as claimed in claim 1, wherein the contact member (1) has a collar (13) disposed on a lower outer wall thereof and the housing (2) has outer threads (23) formed on an upper outer wall thereon, the fixing ring (3) being an annular member, the fixing ring (3) having a reduced upper portion to form an inward flange (31) and a lower portion formed with inner threads on an inner wall thereof, the fixing ring (3) being fitted on the junction of the contact member (1) and the housing (2), the flange (31) at the upper portion of the fixing ring (3) being engaged with the collar (13) on the lower outer wall of the contact member (1), the inner threads formed on the inner wall of the lower portion of the fixing ring (3) being engaged with the outer threads (23) formed on the upper outer wall of the housing (2).

* * * * *